US005464676A

United States Patent [19]

Hoyt et al.

[11] Patent Number: 5,464,676

[45] Date of Patent: Nov. 7, 1995

[54] REDUCED STAINING CARPET YARNS AND CARPET

[75] Inventors: Matthew B. Hoyt, Arden; Phillip E. Wilson, Asheville, both of N.C.

[73] Assignee: BASF Corporation, Mt. Olive, N.J.

[21] Appl. No.: 423,736

[22] Filed: Apr. 18, 1995

Related U.S. Application Data

[60] Division of Ser. No. 262,201, Jun. 20, 1994, which is a continuation-in-part of Ser. No. 900,629, Jun. 18, 1992, abandoned.

[51] Int. Cl.[6] ..... B32B 3/02

[52] U.S. Cl. ..... 428/85; 428/92; 428/397

[58] Field of Search ..... 428/85, 92, 373, 428/374, 397, 395, 400

[56] References Cited

U.S. PATENT DOCUMENTS

| | | | |
|---|---|---|---|
| 3,700,544 | 10/1972 | Matsui | 428/373 |
| 3,725,192 | 4/1973 | Ando et al. | 428/373 |
| 3,760,579 | 9/1973 | Schuettler et al. | 264/177.13 |
| 3,926,924 | 12/1975 | Edgar | 264/177.13 |
| 3,955,022 | 5/1976 | Sands | 428/95 |
| 3,971,202 | 7/1976 | Windely . | |
| 4,006,123 | 2/1977 | Samuelson et al. | 428/395 |
| 4,035,346 | 7/1977 | Samuelson et al. | 428/395 |
| 4,069,657 | 1/1978 | Bascom et al. | 57/160 |
| 4,075,378 | 2/1978 | Anton et al. | 428/374 |
| 4,218,509 | 8/1980 | Edgar | 528/339 |
| 4,226,076 | 10/1980 | Griset, Jr. | 57/12 |
| 4,908,052 | 3/1990 | Largman et al. | 428/373 |
| 5,125,818 | 6/1992 | Yeh | 428/397 |
| 5,162,074 | 11/1992 | Hill | 264/171 |
| 5,208,107 | 5/1993 | Yeh et al. | 428/397 |

FOREIGN PATENT DOCUMENTS

| | | |
|---|---|---|
| 0398221 | 11/1990 | European Pat. Off. . |
| 1904876 | 9/1969 | Germany . |

*Primary Examiner*—N. Edwards

*Attorney, Agent, or Firm*—Nixon & Vanderhye

[57] ABSTRACT

A multi-lobal composite filament with reduced stainability having a polyamide core being substantially free of amine end-groups and being surrounded by a sheath of a hydrophobic polymer of aromatic polyesters, aliphatic polyesters, polyethylene, polymethylpentent, polybutene, polymethyl butene and copolymers thereof, wherein the weight ratio between core and sheath is from about 2:1 to about 10:1. These filaments are particularly useful to the manufacture of carpets.

11 Claims, No Drawings

REDUCED STAINING CARPET YARNS AND CARPET

This is a divisional of application Ser. No. 08/262,201 filed Jun. 20, 1994 which in turn is a continuation-in-part of Ser. No. 07/900,629 filed Jun. 18, 1992, (now abandoned).

FIELD OF THE INVENTION

The present invention relates to composite filaments. More particularly, the invention relates to multilobal composite filaments which include two different components arranged in a sheath core relationship. One of the rationales for providing two-component filaments is to obtain the respective properties of the individual components in one filament. In the present invention the multilobal composite filament has a polyamide core surrounded by a sheath of a hydrophobic polymer.

BACKGROUND OF THE INVENTION

Polyamide has been utilized extensively as a synthetic filament. While its structural and mechanical properties make it attractive for use in such capacities as carpeting, one major disadvantage of polyamide is that it is Easily stained. Therefore, a system that would accentuate the positive mechanical and structural properties of polyamide while at the same time eliminating or decreasing the negative properties with respect to stainability, would constitute a major improvement in the art.

Composite filaments with a sheath core relationship are known in the art. U.S. Pat. No. 3,700,544 discloses a composite filament having two different components arranged in a sheath core relationship. The filaments have an improved flexural rigidity and the sheath component has a better dyeability than the core component. U.S. Pat. No. 3,725,192 discloses a two-component filament of a sheath core type having an improved dyeability. EP-A 399,397 discloses a sheath-core bicomponent filament having antistatic properties wherein the core polymer contains carbon black.

An object of the present invention was to provide filaments with reduced stainability and high mechanical and structural properties.

Another object was a carpet with reduced stainability based on these filaments.

SUMMARY OF THE INVENTION

The objects of the present invention could be achieved with a multi-lobal composite filament with reduced stainability comprising a polyamide core being substantially free of amine end-groups and being surrounded by a sheath of a hydrophobic polymer, selected from the group consisting of aromatic polyesters, aliphatic polyesters, polyethylene, polymethylpentene, polybutene, polymethyl butene and copolymers thereof, wherein the weight ratio between core and sheath is from about 2:1 to about 10:1.

DETAILED DESCRIPTION OF THE INVENTION

Polyamides are well known by the generic term "nylon" and are long chain synthetic polymers containing amide (—CO—NH—) linkages along the main polymer chain. Suitable melt spinnable polyamides for the core of the composite filament of the present invention include those which are obtained by the polymerization of a lactam or an amino acid, or those polymers formed by the condensation of a diamine and a dicarboxylic acid. Typical polyamides include nylon 6, nylon 6/6, nylon 6/9, nylon 6/10, nylon 6T, nylon 6/12, nylon 11, nylon 12 and copolymers thereof or mixtures thereof. Polyamides can also be copolymers of nylon 6 or nylon 6/6 and a nylon salt obtained by reacting a dicarboxylic acid component such as terephthalic acid, isopthalic acid, adipic acid or sebacic acid with a diamine such as hexamethylene diamine, methaxylene diamine, or 1,4-bisaminomethylcyclohexane. Preferred are poly-ε-caprolactam (nylon 6) and polyhexamethylene adipamide (nylon 6/6). Most preferred is nylon 6.

For the purpose of the present invention the polyamides for the core of the composite filament are substantially free of amine end-groups which means the amine end-group content (AEG) is from about 5 to about 45 meq/kg, preferably from about 11 to about 40 meq/kg and most preferred from about 32 to about 38 meq/kg.

The hydrophobic polymer for the sheath of the filament comprises aliphatic and aromatic polyesters and copolyesters like polyethylene terephthalate, polybutylene terephthalate, poly (1,4 cyclohexylenedimethyleneterephthalate), polyethyleneoxy-benzoate, polyglycolide and polypivalolactone; polyolefins like polyethylene, polypropylene, polymethylpentene, polybutene and polymethyl butene. The object of the sheath polymer is to stop the penetration of stains into the fiber. The weight ratio between core and sheath polymer is from about 1:1 to about 10:1, preferably from about 2:1 to about 5:1.

The core polymer may be spun on a conventional extruder fed melt spinner with an additional sidearm extruder for the extrusion of the sheath polymer. This arrangement allows the delivery of both polymers in separate streams to a bicomponent spinnerette pack assembly. The processing temperature for the polyamide for the core depends on the polymer and is, for example for nylon 6, from 250° C. to about 300° C., preferably from about 255° C. to about 285°.

The processing temperature for the hydrophobic polymer for the sheath depends on the polymer and is for example for polybutylene terephthalate from about 255° C. to about 280° C.

The bicomponent spinnerette pack assembly is in a form to produce a multilobal fiber, like a tri-, tetra-, penta- or hexalobal, preferably a trilobal fiber. The assembly is known in the art and described for example in U.S. Pat. No. 5,162,074. Suitable spinnerettes are described in U.S. Pat. No. 5,125,819. Some spinnerettes are suitable to produce hollow fibers. The extruded filaments are quenched for example with air in order to solidify the filaments. The filaments are then treated with a finish comprising a lubricating oil or mixture of oils and antistatic agents. Filaments are then combined to form a yarn bundle which is then wound on a suitable package.

In a subsequent step, the yarn is drawn and texturized to form a bulked continuous filament (BCF) yarn suitable for tufting into carpets. A more preferred technique involves combining the extruded or as-spun filaments into a yarn, then drawing, texturizing and winding a package, all in a single step. This one-step method of making BCF is referred to in the trade as spin-draw-texturing.

Nylon filaments for the purpose of carpet manufacturing have deniers (denier=weight in grams of a single filament with a length of 9000 meters) in the range of about 3 to 75 denier/filament (dpf). A more preferred range for carpet fibers is from about 15 to 25 dpf.

From here, the BCF yarns can go through various processing steps well known to those skilled in the art. The fibers of this invention are particularly useful in the manufacture of carpets for floor covering applications.

To produce carpets for floor covering applications, the BCF yarns are generally tufted into a pliable primary backing. Primary backing materials are generally selected from the group comprising conventional woven jute, woven polypropylene, cellulosic nonwovens, and nonwovens of nylon, polyester, and polypropylene. The primary backing is then coated with a suitable latex material such as a conventional styrene-butadiene latex, vinylidene chloride polymer, or vinyl chloride-vinylidene chloride copolymers. It is common practice to use fillers such as calcium carbonate to reduce latex costs. The final step is to apply a secondary backing, generally a woven jute or woven synthetic such as polypropylene.

It is preferred to use a woven polypropylene primary backing, a conventional styrene-butadiene (SB) latex formulation, and either a woven jute or woven polypropylene secondary carpet backing. The SB latex can include calcium carbonate filler and/or one or more of the hydrate materials listed above.

EXAMPLES

The method for the determination of amino end groups (AEG) of the polyamides is as follows:

2 g of polyamide is dissolved at 50° C. in 60 ml of a solution of 68% by weight of phenol and 32% by weight of methanol and titrated with 0.02 normal hydrochloric acid. The AEG is measured in milliequivalent amine per kg polyamide (meq/kg).

Example 1

In this example nylon 6 and polybutyleneterephthalate (PBT) were used. Both materials are commercially available from BASF Corporation as Ultramid® BS700 and Ultradur® B2550. The amine end group content (AEG) of Ultramid® BS700 was 37 meq/kg. The relative viscosity (RV) of Ultramid® BS700 was 2.7 (1% solution in 90% formic acid at 25° C.). The intrinsic viscosity (IV) of Ultradur® B2550 was 0.84 (0.5% solution in a 50:50 mixture of 1,2 dichloro benzene and phenol at 25° C.). The polymer was spun on a conventional extruder fed melt spinner with an additional sidearm extruder. This arrangement allowed for the delivery of separate streams of nylon 6 and PBT to a bicomponent spinnerette pack assembly.

Nylon 6 was delivered to the spinnerette pack at a rate of 125 g/min and a temperature of 262° C. PBT was delivered to the spinnerette at a rate of 74 g/min at a temperature of 262° C. Once delivered to the spinnerette, the nylon 6 and the PBT are combined in such a way so as to produce a trilobal fiber possessing a longitudinally coextensive trilobal sheath composed of PBT surrounding a nylon 6 core. By varying the respective amounts of nylon 6 and PBT it is possible to produce fibers having different sheath/core volume ratios. Physical property data are shown in Table 1. After exiting the spinnerette the filaments pass through a cross flow quench chamber 1.9 m in length. Quench air is provided at 15° C. and a cross flow velocity of 150 feet/min. The filaments are then processed on a commercially available draw-texture-interlace-wind machine. The take-up machine was operated at a texturing speed of 2000 m/min. Further settings of the machine would be familiar to one skilled in the art.

Example 2

Example 1 was repeated with the difference that PBT was delivered to the spinnerette at a rate of 46.2 g/min at a temperature of 262° C.

Comparison Example

In this comparison example a nylon 6 trilobal fiber was produced under the same conditions as in example 1.

TABLE 1

| Physical Properties | | | | | |
|---|---|---|---|---|---|
| Examples | % Sheath | % Core | Modification Ratio | Denier | Tenacity |
| Cond. 1 | 37 | 63 | 3.6 | 1243 | 2.37 |
| Cond. 2 | 27 | 73 | 3.4 | 1143 | 2.43 |
| Comparison | 0 | 100 | 2.6 | 1300 | 2.80 |

The method to measure the reduced staining is the following:

Filaments to be tested are exposed to a solution of FD&C Red 40 Color Index Food Red 17 (CIFR 17). This solution is prepared by diluting 2.5 grams of commercially available Saurer's Red Food Coloring to one liter with water. This solution is adjusted to pH 2.5 by the addition of citric acid. The mass of the sample to be tested is determined and the sample is placed in a bath ten times the mass of the sample for 5 minutes. For example, an 8 gram sample would be immersed in 80 grams of solution. After exposure to the red food Coloring, the samples are removed and the excess liquid is centrifugally extracted. The samples are then allowed to aid dry for approximately 16 hours. After this time, the samples are rinsed with water until no more stain can be removed. The samples are then centrifugally extracted and tumble dried. When dry the color difference is measured using the CIE 1976 CIELAB DE* color difference function as standardized by CIE (Commission Internationale de l'Eclairage). Thus, an increase in stain resistance would be characterized by a reduction in DE*.

TABLE 2

| Staining Properties | | | |
|---|---|---|---|
| Examples | % Sheath | % Core | DE* (D6500, 10° observer) |
| 1 | 37 | 63 | 32.77 |
| Comp. | 0 | 100 | 51.64 |

The stain experiments were repeated according to the American Association of Textile Chemists and Colorists (AATCC) 175,1991 with the same red food dye described in the previous experiment. The staining results are listed in Table 3.

TABLE 3

| Staining Properties according to AATCC 175 test | | | |
|---|---|---|---|
| Examples | % Sheath | % Core | Total Color Difference CIE L*a*b*, D6500 |
| 1 | 37 | 63 | 43.19 |

TABLE 3-continued

| Staining Properties according to AATCC 175 test | | | |
|---|---|---|---|
| Examples | % Sheath | % Core | Total Color Difference CIE L*a*b*, D6500 |
| 2 | 27 | 73 | 46.39 |
| Comparison | 0 | 100 | 53.68 |

We claim:

1. A carpet which comprises a multilobal composite filament having reduced stainability, said filament comprising a polyamide core having an amine end group content of from about 5 to about 45 meq/kg, and a hydrophobic polymer sheath surrounding said core, said hydrophobic polymer being selected from the group consisting of aromatic polyesters, aliphatic polyesters, polyethylene, polymethylpentene, polybutene, and polymethyl butene, and wherein the weight ratio between said core and said sheath is from about 2:1 to about 10:1.

2. The carpet according to claim 1, wherein said multilobal filament is a trilobal composite filament.

3. The carpet as in claim 1, wherein the multilobal composite filament has a trilobal, tetralobal, pentalobal or hexalobal shape.

4. The carpet as in claim 1, wherein the polyamide is selected from the group consisting of nylon 6, nylon 6/6, nylon 6/9, nylon 6/10, nylon 6/12, nylon 6T, nylon 11, nylon 12, copolymer thereof and mixtures thereof.

5. The carpet as in claim 1, wherein the polyamide is nylon 6 or nylon 6/6.

6. The carpet as in claim 1, wherein the hydrophobic polymer is selected from the group consisting of polyethylene terephthalate, polybutylene terephthalate, poly(1,4 cyclohexylene dimethylene terephthalate), polyethylene oxybenzoate, polyglycolide and polypivalolactone.

7. The carpet as in claim 1, wherein the core is nylon 6 and the sheath is polyethylene terephthalate.

8. The carpet as in claim 1, wherein the core is nylon 6 and the sheath is polybutylene terephthalate.

9. The carpet as in claim 1, wherein the multilobal filament is hollow.

10. The carpet as in claim 1, wherein the weight ratio between the core and the sheath is from about 1:1 to about 10:1.

11. The carpet as in claim 1, wherein the weight ratio between the core and the sheath is from about 2:1 to about 5:1.

* * * * *

UNITED STATES PATENT AND TRADEMARK OFFICE

CERTIFICATE OF CORRECTION

PATENT NO. : 5,464,676

DATED : November 7, 1995

INVENTOR(S) : Matthew B. Hoyt; Phillip E. Wilson

It is certified that error appears in the above-indentified patent and that said Letters Patent is hereby corrected as shown below:

At column 1, line 24, please delete the "E" in "easily" and replace with a lower case "e".

Signed and Sealed this

Eleventh Day of June, 1996

*Attest:*

Bruce Lehman

BRUCE LEHMAN

*Attesting Officer*

*Commissioner of Patents and Trademarks*